US007223723B2

(12) United States Patent
Wilson

(10) Patent No.: US 7,223,723 B2
(45) Date of Patent: May 29, 2007

(54) CLEANING COMPOSITIONS

(75) Inventor: Paul A. Wilson, Canton, GA (US)

(73) Assignee: Victoria E. Wilson and Matthew P. Wilson Trust, Cartersville, GA (US)

( * ) Notice: Subject to any disclaimer, the term of this patent is extended or adjusted under 35 U.S.C. 154(b) by 637 days.

(21) Appl. No.: 10/159,637

(22) Filed: May 30, 2002

(65) Prior Publication Data

US 2003/0224961 A1 Dec. 4, 2003

(51) Int. Cl.
*C11D 3/44* (2006.01)
*C11D 17/00* (2006.01)

(52) U.S. Cl. ..... 510/366; 510/365; 510/188; 510/500; 134/38; 134/40

(58) Field of Classification Search ..... 510/381, 510/225, 445, 380, 379, 306, 302, 403; 134/38, 134/40; 252/186.35
See application file for complete search history.

(56) References Cited

U.S. PATENT DOCUMENTS

| | | | | | |
|---|---|---|---|---|---|
| 3,956,197 | A | | 5/1976 | Schoenholz et al. | 252/526 |
| 3,968,046 | A | | 7/1976 | Smeets | 252/95 |
| 4,102,823 | A | | 7/1978 | Matheson et al. | 252/533 |
| 4,108,681 | A | * | 8/1978 | Lawson et al. | 134/20 |
| 4,552,681 | A | * | 11/1985 | Koch et al. | 510/356 |
| 5,474,698 | A | * | 12/1995 | Rolando et al. | 510/445 |
| 5,514,295 | A | | 5/1996 | Flower | 252/174 |
| 5,789,361 | A | | 8/1998 | Talley | 510/218 |

FOREIGN PATENT DOCUMENTS

| | | | |
|---|---|---|---|
| SU | 1433961 A | * | 10/1988 |
| SU | 1682374 A1 | * | 10/1991 |

* cited by examiner

*Primary Examiner*—Gregory Webb
(74) *Attorney, Agent, or Firm*—Thomas, Kayden, Horstemeyer & Risley, LLP

(57) ABSTRACT

Cleaning compositions and methods of use thereof are described. A representative cleaning composition includes about 0.2% to about 25% of a surfactant and one or more of the following components: about 5% to about 99% of a builder, bout 5% to about 95% of a hydrotrope, about 2% to about 60% of a water conditioner, about 0.1% to about 35% of an alkali, and about 2% to about 85% of a processing aid.

230 Claims, No Drawings

CLEANING COMPOSITIONS

TECHNICAL FIELD

This invention relates to cleaning compositions and methods of use thereof.

BACKGROUND

The vast majority of industrial cleaning problems are solved with existing technology since these problems have existed for many years and the types of material to be cleaned are typical across different industries. Many industrial cleaners are based on solvent technology where the solvent itself provides the cleaning ability of the product. These cleaners may be "pure" solvents like mineral spirits, Stoddard solvent, 1,1,1-trichloroethane, or others known to those who are skilled in the art. Other cleaners include additives such as emulsifiers or surface-active agents. In addition, other cleaners are water-based and contain varying percentages of solvents dissolved in water or emulsified. Solvent and solvent-based cleaners are regulated by Environmental Protection Agency (EPA) both as volatile organic compounds and as potential water and ground pollutants.

One industry that encounters unique cleaning problems is the hot mix asphalt (HMA) industry. HMA is a mixture of liquid asphalt and aggregate with special additives used to modify the final product to yield a particular set of properties to the finished material and to assist in the mixing and handling properties during manufacturing, transportation, and laying of the surface. HMA as the name implies, is hot, with typical temperatures up to and exceeding 340° F., causing problems with cleaning operations. The liquid asphalt is liquid at the elevated temperatures where it is processed into HMA, but becomes sticky and eventually solid as the temperature falls. During the manufacturing and handling processes, HMA adheres to nearly every surface it contacts. Thus, during the process of paving roads, runways, parking areas, etc., HMA adheres to the equipment involved in manufacturing the asphalt, in transporting the asphalt to the paving site, and in disposing the asphalt on the particular site.

Therefore, the HMA industry is unique because of the nature of the materials encountered and the conditions under which the material is made, transported, and applied, as well as environmental problems encountered during cleaning and reclaiming the cleaner. Similar problems exist in similar industries such as the bitumen industry, the tire-manufacturing industry, the rubber manufacturing industry, and other allied industries.

The largest group of industrial cleaners is based on detergents. The products in this group are water based and contain a surfactant (or a combination of surfactants), and other components. However, these cleaners have proven to be ineffective in removing asphalt or related materials during the cleaning process.

Traditionally, diesel fuel is used as a cleaning agent. However, environmental considerations have resulted in the EPA, the Federal Highway Administration, and many state transportation departments to ban its use. Most other solvent-based cleaners are not effective, present fire and explosion hazards at the elevated temperatures, or are not environmentally acceptable. Emulsions or emulsion forming products containing various hydrocarbons, vegetable based oils and esters (i.e., soy and terpene compounds), or other solvents have been used, but they, like diesel fuel, have a negative environmental impact and/or have potential negative human health effects. Other cleaners have, in the past, indicated that they can remove adhered asphalt from surfaces; however, many of these cleaners are expensive and remove less than 45% of the adhered asphalt.

Thus, there is a need in the industry for a cleaning agent that overcomes at least these disadvantages.

SUMMARY OF THE INVENTION

Briefly described, the present invention provides for cleaning compositions and methods of use thereof. A representative cleaning composition includes about 0.2% to about 25% of a surfactant and one or more of the following components: about 5% to about 99% of a builder, about 5% to about 95% of a hydrotrope, about 2% to about 60% of a water conditioner, about 0.1% to about 35% of an alkali, and about 2% to about 85% of a processing aid.

The present invention also provides for methods of using the cleaning compositions to clean equipment. A representative method includes applying a cleaning composition to the equipment. A representative cleaning composition includes about 0.2% to about 25% of a surfactant and one or more of the following components: about 5% to about 99% of a builder, about 5% to about 95% of a hydrotrope, about 2% to about 60% of a water conditioner, about 0.1% to about 35% of an alkali, and about 2% to about 85% of a processing aid.

Other systems, methods, features, and advantages of the present invention will be or become apparent to one with skill in the art upon examination of the following detailed description. It is intended that all such additional systems, methods, features, and advantages be included within this description, be within the scope of the present invention, and be protected by the accompanying claims.

DETAILED DESCRIPTION

The present invention provides for cleaning compositions and methods of use thereof that overcome at least some of the problems associated with cleaning equipment used to, handle, manufacture, transfer, and dispose of materials (e.g., bituminous materials, tar materials, rubber materials, and/or polymer materials). In addition, embodiments of the cleaning composition are generally environmentally acceptable.

Embodiments of the cleaning composition can be used to treat equipment in a broad range of industrial fields. These industries include, for example, the bituminous industry, rubber industry, plastics industry, polymer industry, tar industry, and concrete industry. In particular, these industries include the tire-manufacturing industry, oil industry, the floor tile manufacturing industry, the cold patch asphalt industry, the rubber parts manufacturing industry, roofing industry, and oil industry. Also, the cleaning composition can be used to treat equipment that is used in mix designs such as polymer modified asphalt (PMA) mix designs, crumb rubber mix designs, stone matrix asphalt (SMA) mix designs, superpave mix designs, open grade friction course (OGFC) mix designs, and slag containing asphalt mix designs.

The equipment can include, for example, transportation vehicle beds, waste chutes and belts, tools (e.g., shovel, saws, and rakes), shuttle buggies, paving machines, drag chains, drums, batchers, flop gates, silos, drag conveyors, bucket elevators, and transfer belts.

The materials that come into contact with the equipment discussed above include, for example, bituminous materials, tar materials, rubber materials, polymer materials, or combinations thereof. Bituminous materials include, for example, asphalt, pitch, and bituminous-modified materials. Tar materials include, for example, tar, rosins, and tar-modified materials. Rubber materials include, for example, natural rubber materials, synthetic rubber materials, natural latex, synthetic latex, and rubber-modified materials. Polymer materials include, for example, latex, natural polymers, synthetic polymers, and polymer-modified materials. As indicated for each of the materials above, the cleaning composition can be used to treat modified materials, such as a polymer-modified bituminous material, a rubber-modified polymer, and various blends or mix designs thereof.

Embodiments of the cleaning composition can be used as a cleaning agent, release agent, and/or a preventative agent (i.e., applied to prevent material from adhering to the equipment to maintain cleanliness) to treat equipment. For example, the cleaning composition can be applied (e.g., sprayed or soaked) to equipment having material disposed thereon, in which case the cleaning composition acts as a cleaning agent/release agent that can substantially displace the adhered material. In addition, the cleaning composition acts as a preventative agent after the adhered material is removed. Therefore, the cleaning composition can act as a cleaning/release agent and a cleaning/release/preventative agent.

Alternatively, the cleaning composition can be applied onto equipment that is clean (i.e., equipment having little or no material adhered to it). For example, the cleaning composition acts as a preventative agent when applied to clean equipment because the material does not substantially adhere to the equipment after the cleaning composition was been applied.

Thus, the cleaning composition can be applied before, during, and after use of the equipment. The type of equipment and the industry for which it is used determine how, when, and how much of the cleaning composition is applied to the equipment.

Embodiments of the cleaning composition can include surfactants, and one or more of the following: builders, hydrotropes, alkali compounds (hereinafter "alkali"), processing aids, and water conditioners. The cleaning compositions can be prepared as a powder and diluted with a solvent (e.g., water) to achieve various concentrations of active ingredients (e.g., surfactant, builder, hydrotrope, water conditioner, alkali, and/or processing aid). In addition, the cleaning composition can be applied as a solution, a foam, or an emulsion. Exemplary cleaning compositions are shown below and in Tables 1 and 2.

The cleaning composition can include one or more builders such as, for example, sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate. Preferred builders include sodium metasilicates, potassium silicates, sodium phosphate, sodium carbonate, and potassium carbonate.

The cleaning composition can include one or more water conditioners. In general, the water conditioners can include chelating, sequestering, and/or crystal modifier water conditioners. In particular, the water conditioners can include compounds such as, for example, ethylenediaminetetraacetic acid and salts thereof, nitrilotriacetic acid and salts thereof, sodium citrate, sodium gluconate, sodium glucoheptonate, polymaleic acid, and polyacrylate. Preferred water conditioners include crystal modifiers, ethylenediaminetetraacetic acid and salts, nitrilotriacetic acid, and polymaleic acid salts.

The cleaning composition can include one or more surfactants such as, for example, anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid. Preferred surfactants include phosphate ester detergents, non-ionic detergents, and soaps.

The cleaning composition can include one or more hydrotropic compounds (hydrotropes) such as, for example, sodium xylene sulfonate, sodium toluenesulfonate, surfactant-hydrotropes, and urea. Preferred hydrotropes include sodium xylene sulfonate and urea.

The cleaning composition can include one or more alkalis such as, for example, sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide. Preferred alkalis include sodium hydroxide, potassium hydroxide, magnesium hydroxide, calcium hydroxide, and sodium aluminate.

The cleaning composition can include one or more processing aids such as, for example, carboxymethylcellulose sodium alginate, monosaccharides, disaccharides, trisaccharides, tetrasaccharides, pentasaccharides, hexassaccharides, heptasaccharides, octasaccharides, monasaccharides, gums, guar gums, xanthan, polymethacrylate, polyethylacrylate, mixed polyacrylate-polymalate, and polyacrylic acid partial sodium salt. Preferred processing aids include guar gums, starches, polyacrylates, and saccharides. In addition, dyes or other coloring agents can be added to the cleaning composition.

Components of the cleaning composition that are in the form of a salt may be alternately selected as the sodium salt thereof, potassium salt thereof, calcium salt thereof, magnesium salt thereof, zinc salt thereof, aluminum salt thereof, barium salt thereof, beryllium salt thereof, ammonium salt thereof, or lithium salt thereof, as known to those skilled in the art.

An embodiment of the cleaning composition can include about 0.2 to about 25 weight percent of a surfactant and one or more of the following components: about 5 to about 99 weight percent of a builder, about 5 to about 95 weight percent of a hydrotrope, about 2 to about 60 weight percent of a water conditioner, about 0.1 to about 35 weight percent of an alkali, and about 2 to about 85 weight percent of a processing aid.

A second embodiment of the cleaning composition can include about 0.2 to about 25 weight percent of a surfactant, about 5 to about 99 weight percent of a builder, and one or more of the following components: about 5 to about 95 weight percent of a hydrotrope, about 2 to about 60 weight percent of a water conditioner, about 0.1 to about 35 weight percent of an alkali, and about 2 to about 85 weight percent of a processing aid.

A third embodiment of the cleaning composition can include about 0.2 to about 25 weight percent of a surfactant, about 0.5 to about 99 weight percent of a alkali, and one or more of the following components: about 5 to about 99 weight percent of a hydrotrope, about 2 to about 85 weight percent of a water conditioner, and about 2 to about 95 weight percent of a processing aid.

A fourth embodiment of the cleaning composition can include about 0.2 to about 20 weight percent of a surfactant, about 5 to about 99 weight percent of a hydrotrope, and one or more of the following components: about 2 to about 49 weight percent of a water conditioner and about 2 to about 85 weight percent of a processing aid.

A fifth embodiment of the cleaning composition can include about 0.2 to about 20 weight percent of a surfactant, about 35 to about 49 weight percent of a water conditioner, and about 1 to about 95 weight percent of a processing aid.

A sixth embodiment of the cleaning composition can include about 20 to about 95 weight percent of a builder, about 0.2 to about 20 weight percent of a surfactant, about 5 to about 80 weight percent of a hydrotrope, about 1 to about 30 weight percent of a water conditioner, about 0.1 to about 20 weight percent of an alkali, and about 0.5 to about 95 weight percent of a processing aid.

A seventh embodiment of the cleaning composition can include about 20 to about 50 weight percent of a builder, about 0.2 to about 20 weight percent of a surfactant, about 20 to about 40 weight percent of a hydrotrope, about 1 to about 15 weight percent of a water conditioner, about 0.1 to about 15 weight percent of an alkali, and about 0.5 to about 80 weight percent of a processing aid.

As indicated above, embodiments of the cleaning composition can be diluted with a solvent such as water to prepare a cleaning composition solution having specific concentrations of the active agents. Thereafter, the cleaning composition solution can be applied to the equipment in need of treatment.

Additional embodiments are shown in Tables 1 and 2. Table 1 lists embodiments of the chemical compositions as a powder. Table 2 lists embodiments of the chemical composition diluted in water.

TABLE 1

| Cleaning Composition (CC) | Builder | Surfactant | Alkali | Hydrotrope | Water Conditioner | Processing Aid |
|---|---|---|---|---|---|---|
| CC1 | 85–99 | 0.2–25 | — | — | — | — |
| CC 2 | 75–95 | 0.2–20 | 0.1–25 | — | — | — |
| CC 3 | 35–90 | 0.2–20 | — | 5–95 | — | — |
| CC 4 | 35–90 | 0.2–20 | — | — | 2–60 | — |
| CC 5 | 35–90 | 0.2–20 | — | — | — | 2–85 |
| CC 6 | 35–90 | 0.2–20 | 0.1–35 | 5–95 | — | — |
| CC 7 | 55–90 | 0.2–15 | 1.35 | — | 2–19 | — |
| CC 8 | 55–9 | 0.2–15 | 1–35 | — | — | 2–85 |
| CC 9 | 35–90 | 0.2–20 | 0.1–35 | 5–95 | 2–40 | — |
| CC 10 | 35–90 | 0.2–20 | 0.1–35 | — | 2–40 | 2–85 |
| CC 11 | — | 0.2–15 | 85–99 | — | — | — |
| CC 12 | — | 0.2–20 | 0.5–95 | 5–99 | — | — |
| CC 13 | — | 0.2–20 | 0.5–95 | — | 5–85 | — |
| CC 15 | — | 0.2–20 | 0.5–95 | — | — | 2–95 |
| CC 16 | — | 0.2–20 | 0.5–95 | 35–95 | — | 2–90 |
| CC 17 | — | 0.2–20 | 0.5–95 | — | 2–25 | 2–90 |
| CC 18 | — | 0.2–20 | 0.5–95 | 35–90 | 2–25 | 2–90 |
| CC 19 | — | 0.2–15 | — | 85–99 | — | — |
| CC 20 | — | 0.2–20 | — | 35–97 | 2–49 | — |
| CC 21 | — | 0.2–20 | — | 35–97 | — | 2–85 |
| CC 22 | — | 0.2–20 | — | 35–97 | 2–25 | 2–85 |
| CC 23 | — | 0.2–20 | 35–97 | — | 2–25 | 2–60 |
| CC 24 | — | 0.2–15 | — | — | 85–99 | 0 |
| CC 25 | — | 0.2–20 | — | — | 35–99 | 1–95 |
| CC 26 | 20–46 | 0.2–20 | 0.1–16 | 26–40 | 1–12 | 1–95 |
| CC 27 | 40–95 | 0.2–20 | 0.1–20 | 5–80 | 1–28 | 0.5–80 |

TABLE 2

| Cleaning Composition (CC) | Water | Builder | Surfactant | Alkali | Hydrotrope | Water Conditioner | Processing Aid |
|---|---|---|---|---|---|---|---|
| CC 1 | 20–90 | 2–55 | 0.2–15 | — | — | — | — |
| CC 2 | 20–90 | 2–55 | 0.2–15 | 0.1–30 | — | — | — |
| CC 3 | 20–90 | 2–55 | 0.2–15 | — | 1–48 | — | — |
| CC 4 | 20–90 | 2–55 | 0.2–15 | — | — | 1–18 | — |
| CC 5 | 20–90 | 2–55 | 0.2–15 | — | — | — | 1–70 |
| CC 6 | 20–90 | 2–55 | 0.2–20 | 0.1–30 | 1-–48 | — | — |
| CC 7 | 20–90 | 2–55 | 0.2–20 | 0.1–30 | — | 1–18 | — |
| CC 8 | 20–90 | 2–55 | 0.2–20 | 0.1–30 | — | — | 1–70 |
| CC 9 | 20–90 | 2–55 | 0.2–20 | 0.1–30 | 1–48 | 1–18 | — |
| CC 10 | 20–90 | 2–55 | 0.2–20 | 0.1–30 | — | 1–18 | 1–70 |
| CC 11 | 20–90 | — | 0.2–15 | 1–52 | — | — | — |
| CC 12 | 20–90 | — | 0.2–15 | 0.1–30 | 1–48 | — | — |
| CC 13 | 20–90 | — | 0.2–15 | 0.1–30 | — | 1–48 | — |
| CC 14 | 20–90 | — | 0.2–15 | 0.1–30 | — | — | 1–95 |
| CC 15 | 20–90 | — | 0.2–20 | 0.1–30 | 1–48 | 1–18 | — |
| CC 16 | 20–90 | — | 0.2–20 | 0.1–30 | 1–48 | — | 1–20 |
| CC 17 | 20–90 | — | 0.2–20 | 0.1–30 | — | 1–18 | 1–90 |
| CC 18 | 20–90 | — | 0.2–20 | 0.1–30 | 1–48 | 1–18 | 1–70 |
| CC 19 | 20–90 | — | 0.2–15 | — | 1–48 | — | — |
| CC 20 | 20–90 | — | 0.2–15 | — | 1–48 | 1–18 | — |
| CC 21 | 20–90 | — | 0.2–15 | — | 1–48 | — | 1–80 |
| CC 22 | 20–90 | — | 0.2–20 | — | 1–48 | 1–18 | 1–70 |
| CC 23 | 20–90 | — | 0.2–15 | — | — | 1–46 | — |
| CC 24 | 20–90 | — | 0.2–15 | — | — | 1–46 | 1–90 |
| CC 25 | 10–70 | 2–29 | 0.2–15 | 0.1–30 | 1–44 | 1–18 | 1–41 |
| CC 26 | 16–65 | 1–18 | 0.2–12 | 0.1–12 | 0.5–28 | 0.1–8 | 0.5–60 |

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the principles of the invention. All such modifications and variations are intended to be included herein within the scope of this disclosure and the present invention and protected by the following claims.

I claim:

1. A method of treating equipment, comprising:

applying a basic, single-phase aqueous cleaning composition to equipment, wherein the equipment includes asphalt industry equipment, wherein the cleaning composition includes:

about 0.2% to about 25% of a surfactant;

about 0.1% to about 99% of an alkali; and at least one compound selected from: about 5% to about 99% of a builder, about 5% to about 95% of a hydrotrope, about 2% to about 60% of a water conditioner, and about 2% to about 85% of a processing aid.

2. The method of claim 1, further comprising:

removing a material that is disposed on the equipment.

3. The method of claim 2, wherein the material is bituminous material.

4. The method of claim 2, wherein the material is tar material.

5. The method of claim 2, wherein the material is rubber material.

6. The method of claim 2, wherein the material is a polymer material.

7. The method of claim 2, further comprising:

maintaining the cleanliness of the equipment so that the material does not substantially adhere to the equipment after the cleaning composition has been applied.

8. The method of claim 1, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

9. The method of claim 1, wherein the hydrotrope is selected from the group of compounds consisting of: sodium xylene sulfonate, sodium toluenesulfonate, surfactant-hydrotropes, and urea.

10. The method of claim 1, wherein the water conditioner is selected from the group of compounds consisting of: chelating modifiers, sequestering modifiers, crystal modifiers, polymaleic acid, polyacrylate, ethylenediaminetetraacetic acid, nitrilotriacetic acid, sodium citrate, sodium gluconate, and sodium glucoheptonate.

11. The method of claim 1, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

12. The method of claim 1, wherein the processing aids is selected from the group of compounds consisting of: carboxymethylcellulose, sodium alginate, monosaccharides, disaccharides, trisaccharides, tetrasaccharides, pentasaccharides, hexassaccharides, heptasaccharides, octasaccharides, nonasaccharides, gums, guar gums, xanthan, polymethacrylate, polyethylacrylate, mixed polyacrylate-polymalate, and polyacrylic acid partial sodium salt.

13. The method of claim 1, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

14. The method of claim 1, wherein the cleaning composition can be diluted in a solvent to prepare a cleaning composition solution.

15. The method of claim 1, wherein the builder comprises a builder salt having a cationic species, wherein the cationic species of the salt is selected from: sodium, potassium, calcium, magnesium, zinc, aluminum, barium, beryllium, animonium, and lithium.

16. The method of claim 1, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

17. The method of claim 1, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

18. The method of claim 1, wherein the alkali comprises an alkali salt having a cationic species, wherein the cationic species of the salt is selected from: sodium, potassium, calcium, magnesium, zinc, aluminum, barium, beryllium, ammonium, and lithium.

19. The method of claim 1, wherein the processing aid comprises a processing aid salt having a cationic species, wherein the cationic species of the salt is selected from: sodium, potassium, calcium, magnesium, zinc, aluminum, barium, beryllium, ammonium, and lithium.

20. The method of claim 1, wherein the surfactant comprises a surfactant salt having a cationic species, wherein the cationic species of the salt is selected from: sodium, potassium, calcium, magnesium, zinc, aluminum, barium, beryllium, ammonium, and lithium.

21. A method of treating equipment, comprising:

applying a non-acidic, single-phase aqueous cleaning composition to equipment, wherein the equipment includes asphalt industry equipment, wherein the cleaning composition includes:

about 0.2% to about 25% of a surfactant;

about 0.1% to about 99% of an alkali;

about 5% to about 99% of a builder; and at least one compound selected from: about 5% to about 95% of a hydrotrope, about 2% to about 60% of a water conditioner, and about 2% to about 85% of a processing aid.

22. The method of claim 21, further comprising:

removing a material that is disposed on the equipment.

23. The method of claim 21, wherein the material is selected from a bituminous material, a tar material, a rubber material, a polymer material, and combinations thereof.

24. The method of claim 22, further comprising:

maintaining the cleanliness of the equipment so that the material does not substantially adhere to the equipment after the cleaning composition has been applied.

25. The method of claim 21, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

26. The method of claim 21, wherein the hydrotrope is selected from the group of compounds consisting of: sodium xylene sulfonate, sodium toluenesulfonate, surfactant-hydrotropes, and urea.

27. The method of claim 21, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

28. The method of claim 21, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxid.

29. The method of claim 21, wherein the processing aids is selected from the group of compounds consisting of: carboxymethylcellulose, sodium alginate, monosaccharides, disaccharides, trisaccharides, tetrasaccharides, pentasaccharides, hexassaccharides, heptasaceharides, octasaccharides, nonasaccharides, gums, guar gums, xanthan, polymethacrylate, polyethylacrylate, mixed polyacrylate-polymalate, and polyacrylic acid partial sodium salt.

30. The method of claim 21, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

31. The method of claim 21, wherein the cleaning composition can be diluted in a solvent to prepare a cleaning composition solution.

32. The method of claim 21, wherein the builder comprises a builder salt having a cationic species, wherein the cationic species of the salt is selected from: sodium, potassium, calcium, magnesium, zinc, aluminum, barium, beryllium, ammonium, and lithium.

33. The method of claim 21, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

34. The method of claim 21, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

35. The method of claim 21, wherein the alkali comprises an alkali salt having a cationic species, wherein the cationic species of the salt is selected from: sodium, potassium, calcium, magnesium, zinc, aluminum, barium, beryllium, ammonium, and lithium.

36. The method of claim 21, wherein the processing aid comprises a processing aid salt having a cationic species, wherein the cationic species of the salt is selected from: sodium, potassium, calcium, magnesium, zinc, aluminum, barium, beryllium, ammonium, and lithium.

37. The method of claim 21, wherein the surfactant comprises a surfactant salt having a cationic species, wherein the cationic species of the salt is selected from: sodium, potassium, calcium, magnesium, zinc, aluminum, barium, beryllium, ammonium, and lithium.

38. A method of treating equipment, comprising:

applying a basic, single-phase aqueous cleaning composition to equipment, wherein the equipment includes asphalt industry equipment, wherein the cleaning composition includes:

about 0.2% to about 25% of a surfactant;

about 0.1% to about 99% of a alkali; and at least one compound selected from: about 5% to about 99% of a builder, about 5% to about 95% of a hydrotrope, about 2% to about 60% of a water conditioner, and about 2% to about 85% of a processing aid; and removing a material that is disposed on the equipment without substantially dissolving the material, wherein the material is selected from a bituminous material, a tar material, a rubber material, a polymer material, and combinations thereof.

39. The method of claim 38, further comprising:

maintaining the cleanliness of the equipment so that the material does not substantially adhere to the equipment after the cleaning composition has been applied.

40. The method of claim 38, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

41. The method of claim 38, wherein the hydrotrope is selected from the group of compounds consisting of: sodium xylene sulfonate, sodium toluenesulfonate, surfactant-hydrotropes, and urea.

42. The method of claim 38, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

43. The method of claim 38, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

44. The method of claim 38, wherein the processing aids is selected from the group of compounds consisting of:

carboxymethylcellulose, sodium alginate, monosaccharides, disaccharides, trisaccharides, tetrasaccharides, pentasaccharides, hexassaccharides, heptasaceharides, octasaccharides, nonasaccharides, gums, guar gums, xanthan, polymethacrylate, polyethylacrylate, mixed polyacrylate-polymalate, and polyacrylic acid partial sodium salt.

45. The method of claim 38, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

46. The method of claim 38, wherein the cleaning composition can be diluted in a solvent to prepare a cleaning composition solution.

47. The method of claim 38, wherein the builder comprises a builder salt having a cationic species, wherein the cationic species of the salt is selected from: sodium, potassium, calcium, magnesium, zinc, aluminum, barium, beryllium, ammonium, and lithium.

48. The method of claim 38, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

49. The method of claim 38, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

50. The method of claim 38, wherein the alkali comprises an alkali salt having a cationic species, wherein the cationic species of the salt is selected from: sodium, potassium, calcium, magnesium, zinc, aluminum, barium, beryllium, ammonium, and lithium.

51. The method of claim 38, wherein the processing aid comprises a processing aid salt having a cationic species, wherein the cationic species of the salt is selected from: sodium, potassium, calcium, magnesium, zinc, aluminum, barium, beryllium, ammonium, and lithium.

52. The method of claim 38, wherein the surfactant comprises a surfactant salt having a cationic species, wherein the cationic species of the salt is selected from: sodium, potassium, calcium, magnesium, zinc, aluminum, barium, beryllium, ammonium, and lithium.

53. A method of treating equipment, comprising:

applying a non-acidic, single-phase aqueous cleaning composition to equipment, wherein the equipment includes asphalt industry equipment, wherein the cleaning composition includes:

about 0.2% to about 25% of a surfactant;

about 0.1% to about 99% of an alkali;

about 5% to about 99% of a hydrotrope; and at least one compound selected from: about 5% to about 99% of a builder, about 2% to about 60% of a water conditioner, and about 2% to about 85% of a processing aid; and removing a material that is disposed on the equipment without substantially dissolving the material, wherein the material is selected from a bituminous material, a tar material, a rubber material, a polymer material, and combinations thereof.

54. The method of claim 53, further comprising:

maintaining the cleanliness of the equipment so that the material does not substantially adhere to the equipment after the cleaning composition has been applied.

55. The method of claim 53, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

56. The method of claim 53, wherein the hydrotrope is selected from the group of compounds consisting of: sodium xylene sulfonate, sodium toluenesulfonate, surfactant-hydrotropes, and urea.

57. The method of claim 53, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

58. The method of claim 53, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

59. The method of claim 53, wherein the processing aids is selected from the group of compounds consisting of: carboxymethylcellulose, sodium alginate, monosaccharides, disaccharides, trisaccharides, tetrasaccharides, pentasaccharides, hexassaccharides, heptasaccharides, octasaccharides, nonasaccharides, gums, guar gums, xanthan, polymethacrylate, polyethylacrylate, mixed polyacrylate-polymalate, and polyacrylic acid partial sodium salt.

60. The method of claim 53, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

61. The method of claim 53, wherein the cleaning composition can be diluted in a solvent to prepare a cleaning composition solution.

62. The method of claim 53, wherein the builder comprises a builder salt having a cationic species, wherein the cationic species of the salt is selected from: sodium, potassium, calcium, magnesium, zinc, aluminum, barium, beryllium, ammonium, and lithium.

63. The method of claim 53, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

64. The method of claim 53, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

65. The method of claim 53, wherein the alkali comprises an alkali salt having a cationic species, wherein the cationic species of the salt is selected from: sodium, potassium, calcium, magnesium, zinc, aluminum, barium, beryllium, ammonium, and lithium.

66. The method of claim 53, wherein the processing aid comprises a processing aid salt having a cationic species, wherein the cationic species of the salt is selected from: sodium, potassium, calcium, magnesium, zinc, aluminum, barium, beryllium, ammonium, and lithium.

67. The method of claim 53, wherein the surfactant comprises a surfactant salt having a cationic species, wherein the cationic species of the salt is selected from: sodium, potassium, calcium, magnesium, zinc, aluminum, barium, beryllium, ammonium, and lithium.

68. A method of treating equipment, comprising:

applying a cleaning composition to equipment, wherein the equipment includes asphalt industry equipment, wherein the cleaning composition includes:

about 0.2% to about 25% of a surfactant;

about 2% to about 60% of a water conditioner;

about 2% to about 85% of a processing aid, wherein the processing aid is selected from the group of compounds consisting of: carboxymethylcellulose, sodium alginate, monosaccharides, disaccharides, trisaccharides, tetrasaccharides, pentasaccharides, hexassaccharides, heptasaccharides, octasaccharides, nonasaccharides, gums, guar gums, xanthan, polymethacrylate, polyethylacrylate, mixed polyacrylate-polymalate, and polyacrylic acid partial sodium salt; and at least one compound selected from: about 5% to about 99% of a builder, about 5% to about 95% of a hydrotrope, and about 0.1% to about 99% of an alkali.

69. The method of claim 68, further comprising:

removing a material that is disposed on the equipment.

70. The method of claim 69, wherein the material is selected from a bituminous material, a tar material, a rubber material, a polymer material, and combinations thereof.

71. The method of claim 69, further comprising:

maintaining the cleanliness of the equipment so that the material does not substantially adhere to the equipment after the cleaning composition has been applied.

72. The method of claim 68, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

73. The method of claim 68, wherein the hydrotrope is selected from the group of compounds consisting of: sodium xylene sulfonate, sodium toluenesulfonate, surfactant-hydrotropes, and urea.

74. The method of claim 68, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

75. The method of claim 68, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

76. The method of claim 68, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

77. The method of claim 68, wherein the cleaning composition can be diluted in a solvent to prepare a cleaning corn solution.

78. The method of claim 68, wherein the builder comprises a builder salt having a cationic species, wherein the cationic species of the salt is selected from: sodium, potassium, calcium, magnesium, zinc, aluminum, barium, beryllium, ammonium, and lithium.

79. The method of claim 68, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

80. The method of claim 68, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

81. The method of claim 68, wherein the alkali comprises an alkali salt having a cationic species, wherein the cationic species of the salt is selected from: sodium, potassium, calcium, magnesium, zinc, aluminum, barium, beryllium, ammonium, and lithium.

82. The method of claim 68, wherein the processing aid comprises a processing aid salt having a cationic species, wherein the cationic species of the salt is selected from: sodium, potassium, calcium, magnesium, zinc, aluminum, barium, beryllium, ammonium, and lithium.

83. The method of claim 68, wherein the surfactant comprises a surfactant salt having a cationic species, wherein the cationic species of the salt is selected from: sodium, potassium, calcium, magnesium, zinc, aluminum, barium, beryllium, ammonium, and lithium.

84. A method of treating equipment, comprising:

applying a cleaning composition to equipment, wherein the equipment is selected from bitumen industry equipment, tire-manufacturing industry equipment, rubber manufacturing industry equipment, plastic industry equipment, polymer industry equipment, roofing industry equipment, and oil industry equipment, wherein the cleaning composition includes:

about 0.2% to about 25% of a surfactant;

about 2% to about 85% of a processing aid, wherein the processing aid is selected from the group of compounds consisting of: carboxymethylcellulose, sodium alginate, monosaccharides, disaccharides, trisaccharides, tetrasaccharides, pentasaccharides, hexassaccharides, heptasaccharides, octasaccharides, nonasaccharides, gums, guar gums, xanthan, polymethacrylate, polyethylacrylate, mixed polyacrylate-polymalate, and polyacrylic acid partial sodium salt; and at least one compound selected from: about 5% to about 99% of a builder, about 5% to about 95% of a hydrotrope, about 2% to about 60% of a water conditioner, and about 0.1% to about 99% of an alkali; and removing a material that is disposed on the equipment without substantially dissolving the material, wherein the material is selected from a bituminous material, a tar material, a rubber material, a polymer material, and combinations thereof.

85. The method of claim 84, further comprising:

maintaining the cleanliness of the equipment so that the material does not substantially adhere to the equipment after the cleaning composition has been applied.

86. The method of claim 84, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

87. The method of claim 84, wherein the hydrotrope is selected from the group of compounds consisting of: sodium xylene sulfonate, sodium toluenesulfonate, surfactant-hydrotropes, and urea.

88. The method of claim 84, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

89. The method of claim 84, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

90. The method of claim 84, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

91. The method of claim 84, wherein the cleaning composition can be diluted in a solvent to prepare a cleaning composition solution.

92. The method of claim 84, wherein the builder comprises a builder salt having a cationic species, wherein the cationic species of the salt is selected from: sodium, potassium, calcium, magnesium, zinc, aluminum, barium, beryllium, ammonium, and lithium.

93. The method of claim 84, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

94. The method of claim 84, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

95. The method of claim 84, wherein the alkali comprises an alkali salt having a cationic species, wherein the cationic species of the salt is selected from: sodium, potassium, calcium, magnesium, zinc, aluminum, barium, beryllium, ammonium, and lithium.

96. The method of claim 84, wherein the processing aid comprises a processing aid salt having a cationic species, wherein the cationic species of the salt is selected from: sodium, potassium, calcium, magnesium, zinc, aluminum, barium, beryllium, ammonium, and lithium.

97. The method of claim 84, wherein the surfactant comprises a surfactant salt having a cationic species, wherein the cationic species of the salt is selected from: sodium, potassium, calcium, magnesium, zinc, aluminum, barium, beryllium, ammonium, and lithium.

98. A method of treating equipment, comprising:

applying a cleaning composition to equipment, wherein the equipment is selected from bitumen industry equipment, tire-manufacturing industry equipment, rubber manufacturing industry equipment, plastic industry equipment, polymer industry equipment, roofing industry equipment, and oil industry equipment, wherein the cleaning composition consists essentially of:

about 0.2% to about 25% of a surfactant;

about 5% to about 99% of a builder; and at least one compound selected from: about 5% to about 95% of a hydrotrope, about 2% to about 60% of a water conditioner, about 0.1% to about 99% of an alkali, and about 2% to about 85% of a processing aid.

99. The method of claim 98, further comprising:

removing a material that is disposed on the equipment.

100. The method of claim 99, wherein the material is selected from a bituminous material, a tar material, a rubber material, a polymer material, and combinations thereof.

101. The method of claim 99, further comprising:

maintaining the cleanliness of the equipment so that the material does not substantially adhere to the equipment after the cleaning composition has been applied.

102. The method of claim 98, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

103. The method of claim 98, wherein the hydrotrope is selected from the group of compounds consisting of: sodium xylene sulfonate, sodium toluenesulfonate, surfactant-hydrotropes, and urea.

104. The method of claim 98, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

105. The method of claim 98, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

106. The method of claim 98, wherein the processing aids is selected from the group of compounds consisting of:

carboxymethylcellulose, sodium alginate, monosaccharides, disaccharides, trisaccharides, tetrasaccharides, pentasaccharides, hexassaccharides, heptasaceharides, octasaccharides, nonasaccharides, gums, guar gums, xanthan, polymethacrylate, polyethylacrylate, mixed polyacrylate-polymalate, and polyacrylic acid partial sodium salt.

107. The method of claim 98, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

108. The method of claim 98, wherein the cleaning composition can be diluted in a solvent to prepare a cleaning composition solution.

109. The method of claim 98, wherein the builder comprises a builder salt having a cationic species, wherein the cationic species of the salt is selected from: sodium, potassium, calcium, magnesium, zinc, aluminum, barium, beryllium, ammonium, and lithium.

110. The method of claim 98, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

111. The cleaning method of claim 98, wherein the water conditioner comprises a water conditioner salt having a cationic species, wherein the cationic species of the salt is selected from: sodium, potassium, calcium, magnesium, zinc, aluminum, barium, beryllium, animonium, and lithium.

112. The method of claim 98, wherein the alkali comprises an alkali salt having a cationic species, wherein the cationic species of the salt is selected from: sodium, potassium, calcium, magnesium, zinc, aluminum, barium, beryllium, ammonium, and lithium.

113. The method of claim 98, wherein the processing aid comprises a processing aid salt having a cationic species, wherein the cationic species of the salt is selected from: sodium, potassium, calcium, magnesium, zinc, aluminum, barium, beryllium, ammonium, and lithium.

114. The method of claim 98, wherein the surfactant comprises a surfactant salt having a cationic species, wherein the cationic species of the salt is selected from: sodium, potassium, calcium, magnesium, zinc, aluminum, barium, beryllium, ammonium, and lithium.

115. A method of treating equipment, comprising:

applying a cleaning composition to equipment, wherein the equipment is selected from bitumen industry equipment, tire-manufacturing industry equipment, rubber manufacturing industry equipment, plastic industry equipment, polymer industry equipment, roofing industry equipment, and oil industry equipment, wherein the cleaning composition consists essentially of:

about 0.2% to about 25% of a surfactant;

about 0.5% to about 99% of a alkali; and at least one compound selected from: about 5% to about 99% of a builder, about 5% to about 9:5% of a hydrotrope, about 2% to about 60% of a water conditioner, and about 2% to about 85% of a processing aid; and removing a material that is disposed on the equipment without substantially dissolving the material, wherein the material is selected from a bituminous material, a tar material, a rubber material, a polymer material, and combinations thereof.

116. The method of claim 115, further comprising:

maintaining the cleanliness of the equipment so that the material does not substantially adhere to the equipment after the cleaning composition has been applied.

117. The method of claim 115, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

118. The method of claim 115, wherein the hydrotrope is selected from the group of compounds consisting of: sodium xylene sulfonate, sodium toluenesulfonate, surfactant-hydrotropes, and urea.

119. The method of claim 115, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

120. The method of claim 115, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

121. The method of claim 115, wherein the processing aids is selected from the group of compounds consisting of: carboxymethylcellulose, sodium alginate, monosaccharides, disaccharides, trisaccharides, tetrasaccharides, pentasaccharides, hexassaccharides, heptasaccharides, octasaccharides, nonasaccharides, gums, guar gums, xanthan, polymethacrylate, polyethylacrylate, mixed polyacrylate-polymalate, and polyacrylic acid partial sodium salt.

122. The method of claim 115, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

123. The method of claim 115, wherein the cleaning composition can be diluted in a solvent to prepare a cleaning composition solution.

124. The method of claim 115, wherein the builder comprises a builder salt having a cationic species, wherein the cationic species of the salt is selected from: sodium, potassium, calcium, magnesium, zinc, aluminum, barium, beryllium, ammonium, and lithium.

125. The method of claim 115, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

126. The method of claim 115, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

127. The method of claim 115, wherein the alkali comprises an alkali salt having a cationic species, wherein the cationic species of the salt is selected from: sodium, potassium, calcium, magnesium, zinc, aluminum, barium, beryllium, ammonium, and lithium.

128. The method of claim 115, wherein the processing aid comprises a processing aid salt having a cationic species, wherein the cationic species of the salt is selected from: sodium, potassium, calcium, magnesium, zinc, aluminum, barium, beryllium, ammonium, and lithium.

129. The method of claim 115, wherein the surfactant comprises a surfactant salt having a cationic species, wherein the cationic species of the salt is selected from: sodium, potassium, calcium, magnesium, zinc, aluminum, barium, beryllium, ammonium, and lithium.

130. A method of treating equipment, comprising:

applying a cleaning composition to equipment, wherein the equipment is selected from bitumen industry equipment, tire-manufacturing industry equipment, rubber manufacturing industry equipment, plastic industry equipment, polymer industry equipment, roofing industry equipment, and oil industry equipment, wherein the cleaning composition consists essentially of:

about 0.2% to about 25% of a surfactant;

about 0.1% to about 99% of an alkali; and about 5% to about 99% of a hydrotrope; and at least one compound selected from: about 5% to about 99% of a builder, and about 2% to about 60% of a water conditioner, and about 2% to about 85% of a processing aid; and removing a material that is disposed on the equipment without substantially dissolving the material, wherein the material is selected from a bituminous material, a tar material, a rubber material, a polymer material, and combinations thereof.

131. The method of claim 130, further comprising:

maintaining the cleanliness of the equipment so that the material does not substantially adhere to the equipment after the cleaning composition has been applied.

132. The method of claim 130, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

133. The method of claim 130, wherein the hydrotrope is selected from the group of compounds consisting of: sodium xylene sulfonate, sodium toluenesulfonate, surfactant-hydrotropes, and urea.

134. The method of claim 130, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

135. The method of claim 130, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

136. The method of claim 130, wherein the processing aids is selected from the group of compounds consisting of: carboxymethylcellulose, sodium alginate, monosaccharides, disaccharides, trisaccharides, tetrasaccharides, pentasaccharides, hexassaccharides, heptasaccharides, octasaccharides, nonasaccharides, gums, guar gums, xanthan, polymethacrylate, polyethylacrylate, mixed polyacrylate-polymalate, and polyacrylic acid partial sodium salt.

137. The method of claim 130, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

138. The method of claim 130, wherein the cleaning composition can be diluted in a solvent to prepare a cleaning composition solution.

139. The method of claim 130, wherein the builder comprises a builder salt having a cationic species, wherein the cationic species of the salt is selected from: sodium, potassium, calcium, magnesium, zinc, aluminum, barium, beryllium, ammonium, and lithium.

140. The method of claim 130, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

141. The method of claim 130, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

142. The method of claim 130, wherein the alkali comprises an alkali salt having a cationic species, wherein the cationic species of the salt is selected from: sodium, potassium, calcium, magnesium, zinc, aluminum, barium, beryllium, ammonium, and lithium.

143. The method of claim 130, wherein the processing aid comprises a processing aid salt having a cationic species, wherein the cationic species of the salt is selected from: sodium, potassium, calcium, magnesium, zinc, aluminum, barium, beryllium, ammonium, and lithium.

144. The method of claim 130, wherein the surfactant comprises a surfactant salt having a cationic species, wherein the cationic species of the salt is selected from: sodium, potassium, calcium, magnesium, zinc, aluminum, barium, beryllium, animonium, and lithium.

145. A method of treating equipment, comprising:

applying a cleaning composition to equipment, wherein the equipment is selected from bitumen industry equipment, tire manufacturing industry equipment, rubber manufacturing industry equipment, plastic industry equipment, polymer industry equipment, roofing industry equipment, and oil industry equipment, wherein the cleaning composition consists essentially of:

about 0.2% to about 25% of a surfactant;

about 2% to about 60% of a water conditioner;

about 2% to about 85% of a processing aid; and at least one compound selected from: about 5% to about 99% of a builder, about 5% to about 95% of a hydrotrope, and about 0.1% to about 99% of an alkali.

146. The method of claim 145, further comprising:

removing a material that is disposed on the equipment.

147. The method of claim 146, wherein the material is selected from a bituminous material, a tar material, a rubber material, a polymer material, and combinations thereof.

148. The method of claim 146, further comprising:

maintaining the cleanliness of the equipment so that the material does not substantially adhere to the equipment after the cleaning composition has been applied.

149. The method of claim 145, the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

150. The method of claim 145, wherein the hydrotrope is selected from the group of compounds consisting of: sodium xylene sulfonate, sodium toluenesulfonate, surfactant-hydrotropes, and urea.

151. The method of claim 145, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate and sodium glucoheptonate.

152. The method of claim 145, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

153. The method of claim 145, wherein the processing aids is selected from the group of compounds consisting of: carboxymethylcellulose, sodium alginate, monosaccharides, disaccharides, trisaccharides, tetrasaccharides, pentasaccharides, hexassaccharides, heptasaccharides, octasaccharides, nonasaccharides, gums, guar gums, xanthan, polymethacrylate, polyethylacrylate, mixed polyacrylate-polymalate, and polyacrylic acid partial sodium salt.

154. The method of claim 145, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, Coconut fatty acid, stearic acid, oleic acid, and palmitic acid.

155. The method of claim 145, wherein the cleaning composition can be diluted in a solvent to prepare a cleaning composition solution.

156. The method of claim 145, wherein the builder comprises a builder salt having a cationic species, Wherein the cationic species of the salt is selected from: sodium, potassium, calcium, magnesium, zinc, aluminum, barium, beryllium, ammonium, and lithium.

157. The method of claim 145, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

158. The method of claim 145, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

159. The method of claim 145, wherein the alkali comprises an alkali salt having a cationic species, wherein the cationic species of the salt is selected from: sodium, potassium, calcium, magnesium, zinc, aluminum, barium, beryllium, ammonium, and lithium.

160. The method of claim 145, wherein the processing aid comprises a processing aid salt having a cationic species, wherein the cationic species of the salt is selected from: sodium, potassium, calcium, magnesium, zinc, aluminum, barium, beryllium, animonium, and lithium.

161. The method of claim 145, wherein the surfactant comprises a surfactant salt having a cationic species, wherein the cationic species of the salt is selected from: sodium, potassium, calcium, magnesium, zinc, aluminum, barium, beryllium, animonium, and lithium.

162. A method of treating equipment, comprising:

applying a cleaning composition to equipment, wherein the cleaning composition consists essentially of:

about 0.2% to about 25% of a surfactant; and at least one compound selected from: about 5% to about 99% of a builder, about 5% to about 95% of a hydrotrope, about 2% to about 60% of a water conditioner, about 0.1% to about 99% of an alkali, and about 2% to about 85% of a processing aid; and removing a material that is disposed on the equipment, without substantially dissolving the material, wherein the material is selected from a bituminous material, a tar material, a rubber material, a polymer material, and combinations thereof.

163. The method of claim 162, further comprising:

maintaining the cleanliness of the equipment so that the material does not substantially adhere to the equipment after the cleaning composition has been applied.

164. The method of claim 162, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

165. The method of claim 162, wherein the hydrotrope is selected from the group of compounds consisting of: sodium xylene sulfonate, sodium toluenesulfonate, surfactant-hydrotropes, and urea.

166. The method of claim 162, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

167. The method of claim 162, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

168. The method of claim 162, wherein the processing aids is selected from the group of compounds consisting of: carboxymethylcellulose, sodium alginate, monosaccharides, disaccharides, trisaccharides, tetrasaccharides, pentasaccharides, hexassaccharides, heptasaccharides, octasaccharides, nonasaccharides, gums, guar gums, xanthan, polymethacrylate, polyethylacrylate, mixed polyacrylate-polymalate, and polyacrylic acid partial sodium salt.

169. The method of claim 162, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

170. The method of claim 162, wherein the cleaning composition can be diluted in a solvent to prepare a cleaning composition solution.

171. The cleaning method of claim 162, wherein the builder comprises a builder salt having a cationic species, wherein the cationic species of the salt is selected from: sodium, potassium, calcium, magnesium, zinc, aluminum, barium, beryllium, ammonium, and lithium.

172. The method of claim 162, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

173. The method of claim 162, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

174. The method of claim 162, wherein the alkali comprises an alkali salt having a cationic species, wherein the cationic species of the salt is selected from: sodium, potassium, calcium, magnesium, zinc, aluminum, barium, beryllium, ammonium, and lithium.

175. The method of claim 162, wherein the processing aid comprises a processing aid salt having a cationic species, wherein the cationic species of the salt is selected from: sodium, potassium, calcium, magnesium, zinc, aluminum, barium, beryllium, animonium, and lithium.

176. The method of claim 162, wherein the surfactant comprises a surfactant salt having a cationic species, wherein the cationic species of the salt is selected from: sodium, potassium, calcium, magnesium, zinc, aluminum, barium, beryllium, ammonium, and lithium.

177. A method of treating equipment, comprising:

applying a cleaning composition to equipment, wherein the cleaning composition consists essentially of:

about 0.2% to about 25% of a surfactant;

about 5% to about 99% of a builder; and at least one compound selected from: about 5% to about 95% of a hydrotrope, about 2% to about 60% of a water conditioner, about 0.1% to about 99% of an alkali, and about 2% to about 85% of a processing aid; and removing a material that is disposed on the equipment, without substantially dissolving the material, wherein the material is selected from a bituminous material, a tar material, a rubber material, a polymer material, and combinations thereof.

178. The method of claim 177, further comprising:

maintaining the cleanliness of the equipment so that the material does not substantially adhere to the equipment after the cleaning composition has been applied.

179. The method of claim 177, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

180. The method of claim 177, wherein the hydrotrope is selected from the group of compounds consisting of: sodium xylene sulfonate, sodium toluenesulfonate, surfactant-hydrotropes, and urea.

181. The method of claim 177, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

182. The method of claim 177, the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

183. The method of claim 177, wherein the processing aids is selected from the group of compounds consisting of: carboxymethylcellulose, sodium alginate, monosaccharides, disaccharides, trisaccharides, tetrasaccharides, pentasaccharides, hexassaccharides, heptasaccharides, octasaccharides, nonasaccharides, gums, guar gums, xanthan, polymethacrylate, polyethylacrylate, mixed polyacrylate-polymalate, and polyacrylic acid partial sodium salt.

184. The method of claim 177, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

185. The method of claim 177, wherein the cleaning composition can be diluted in a solvent to prepare a cleaning composition solution.

186. The method of claim 177, wherein the builder comprises a builder salt having a cationic species, wherein the cationic species of the salt is selected from: sodium, potassium, calcium, magnesium, zinc, aluminum, barium, beryllium, ammonium, and lithium.

187. The method of claim 177, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

188. The method of claim 177, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

189. The method of claim 177, wherein the alkali comprises an alkali salt having a cationic species, wherein the cationic species of the salt is selected from: sodium, potassium, calcium, magnesium, zinc, aluminum, barium, beryllium, ammonium, and lithium.

190. The method of claim 177, wherein the processing aid comprises a processing aid salt having a cationic species, wherein the cationic species of the salt is selected from: sodium, potassium, calcium, magnesium, zinc, aluminum, barium, beryllium, ammonium, and lithium.

191. The method of claim 177, wherein the surfactant comprises a surfactant salt having a cationic species, wherein the cationic species of the salt is selected from: sodium, potassium, calcium, magnesium, zinc, aluminum, barium, beryllium, ammonium, and lithium.

192. A method of treating equipment, comprising:

applying a cleaning composition to equipment, wherein the cleaning composition consists essentially of:
about 0.2% to about 25% of a surfactant;
about 0.1% to about 99% of a alkali; and at least one compound selected from: about 5% to about 99% of a builder, about 5% to about 95% of a hydrotrope, about 2% to about 60% of a water conditioner, and about 2% to about 85% of a processing aid; and removing a material that is disposed on the equipment, without substantially dissolving the material, wherein the material is selected from a bituminous material, a tar material, a rubber material, a polymer material, and combinations thereof.

193. The method of claim 192, further comprising:

maintaining the cleanliness of the equipment so that the material does not substantially adhere to the equipment after the cleaning composition has been applied.

194. The method of claim 192, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

195. The method of claim 192, wherein the hydrotrope is selected from the group of compounds consisting of: sodium xylene sulfonate, sodium toluenesulfonate, surfactant-hydrotropes, and urea.

196. The method of claim 192, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

197. The method of claim 192, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide.

198. The method of claim 192, wherein the processing aids is selected from the group of compounds consisting of: carboxymethylcellulose, sodium alginate, monosaccharides, disaccharides, trisaccharides, tetrasaccharides, pentasaccharides, hexassaccharides, heptasaccharides, octasaccharides, nonasaccharides, gums, guar gums, xanthan, polymethacrylate, polyethylacrylate, mixed polyacrylate-polymalate, and polyacrylic acid partial sodium salt.

199. The method of claim 192, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid.

200. The method of claim 192, wherein the cleaning composition can be diluted in a solvent to prepare a cleaning composition solution.

201. The method of claim 192, wherein the builder comprises a builder salt having a cationic species, wherein the cationic species of the salt is selected from: sodium, potassium, calcium, magnesium, zinc, aluminum, barium, beryllium, ammonium, and lithium.

202. The method of claim 192, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

203. The method of claim 192, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

204. The method of claim 192, wherein the alkali comprises an alkali salt having a cationic species, wherein the cationic species of the salt is selected from: sodium, potassium, calcium, magnesium, zinc, aluminum, barium, beryllium, ammonium, and lithium.

205. The method of claim 192, wherein the processing aid comprises a processing aid salt having a cationic species, wherein the cationic species of the salt is selected from: sodium, potassium, calcium, magnesium, zinc, aluminum, barium, beryllium, ammonium, and lithium.

206. The method of claim 192, wherein the surfactant comprises a surfactant salt having a cationic species, wherein the cationic species of the salt is selected from: sodium, potassium, calcium, magnesium, zinc, aluminum, barium, beryllium, ammonium, and lithium.

207. A method of treating equipment, comprising:

applying a cleaning composition to equipment, wherein the cleaning composition consists essentially of:
about 0.2% to about 25% of a surfactant;
about 5% to about 99% of a hydrotrope; and
at least one compound selected from: about 5% to about 99% of a builder, about 2% to about 60% of a water conditioner, about 0.1% to about 99% of an alkali, and about 2% to about 85% of a processing aid; and removing a material that is disposed on the equipment, without substantially dissolving the material, wherein the material is selected from a bituminous material, a tar material, a rubber material, a polymer material, and combinations thereof.

208. The method of claim 207, further comprising:

maintaining the cleanliness of the equipment so that the material does not substantially adhere to the equipment after the cleaning composition has been applied.

209. The method of claim 207, wherein the builder is selected from the group of compounds consisting of: starch, monosodium phosphate, disodium phosphate, trisodium phosphate, sodium tripolyphosphate, sodium sulfate, sodium borate, sodium carbonate, sodium hydrogen carbonate, sodium sesquicarbonate, sodium metasilicate, sodium orthosilicate, sodium sesquisilicate, sodium polysilicates, alkaline sodium silicate, and neutral sodium silicate.

210. The method of claim 207, wherein the hydrotrope is selected from the group of compounds consisting of: sodium xylene sulfonate, sodium toluenesulfonate, surfactant-hydrotropes, and urea.

211. The method of claim 207, wherein the water conditioner is selected from the group of compounds consisting of: chelating modifiers, sequestering modifiers, crystal modifiers, polymaleic acid, polyacrylate, ethylenediamine-tetraacetic acid, nitrilotriacetic acid, sodium citrate, sodium gluconate, and sodium glucoheptonate.

212. The method of claim 207, wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, animonium hydroxide, sodium aluminate, calcium oxide, magnesium oxide, calcium hydroxide, and magnesium hydroxide.

213. The method of claim 207, wherein the processing aids is selected from the group of compounds consisting of carboxymethylcellulose, sodium alginate, monosaccharides, disaccharides, trisaccharides, tetrasaccharides, pentasaccharides, hexassaccharides, heptasaccharides, octasaccharides, nonasaccharides, gums, guar gums, xanthan, polymethacrylate, polyethylacrylate, mixed polyacrylate-polymalate, and polyacrylic acid partial sodium salt.

214. The method of claim 207, wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatly acid esters, potassium soaps of fatty acids, potassium soaps of fatty acid esters, lard, tall oil, coconut fatty acid, stearic acid, oleic acid, and palmitic acid.

215. The method of claim 207, wherein the cleaning composition can be diluted in a solvent to prepare a cleaning composition solution.

216. The method of claim 207, wherein the builder comprises a builder salt having a cationic species, wherein the cationic species of the salt is selected from: sodium, potassium, calcium, magnesium, zinc, aluminum, barium, beryllium, animonium, and lithium.

217. The method of claim 207, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

218. The method of claim 207, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

219. The method of claim 207, wherein the alkali comprises an alkali salt having a cationic species, wherein the cationic species of the salt is selected from: sodium, potassium, calcium, magnesium, zinc, aluminum, barium, beryllium, ammonium, and lithium.

220. The method of claim 207, wherein the processing aid comprises a processing aid salt having a cationic species, wherein the cationic species of the salt is selected from: sodium, potassium, calcium, magnesium, zinc, aluminum, barium, beryllium, ammonium, and lithium.

221. The method of claim 207, wherein the surfactant comprises a surfactant salt having a cationic species, wherein the cationic species of the salt is selected from: sodium, potassium, calcium, magnesium, zinc, aluminum, barium, beryllium, ammonium, and lithium.

222. A method of treating equipment, comprising:

applying a cleaning composition to equipment, wherein the cleaning composition includes:

about 0.2% to about 25% of a surfactant;

about 2% to about 60% of a water conditioner;

about 2% to about 85% of a processing aid; and at least one compound selected from: about 5% to about 99% of a builder, about 5% to about 95% of a hydrotrope, and about 0.1% to about 99% of an alkali, wherein the builder is selected from the group of compounds consisting of: starch, sodium or potassium phosphate, sodium or potassium tripolyphosphate, sodium or potassium sulfate, sodium or potassium borate, sodium or potassium carbonate, sodium or potassium hydrogen carbonate, sodium or potassium sesquicarbonate, sodium or potassium metasilicate, sodium or potassium orthosilicate, sodium or potassium sesquisilicate, sodium or potassium polysilicate, alkaline sodium or potassium silicate, and neutral sodium or potassium silicate;

wherein the processing aid is selected from the group of compounds consisting of: carboxymethylcellulose, sodium alginate, monosaccharides, disaccharides, trisaccharides, tetrasaccharides, pentasaccharides, hexassaccharides, heptasaccharids, octasaccharides, nonasaccharides, gums, guar gums, xanthan, polymethacrylate, polyethylacrylate, mixed polyacrylate-polymalate, and polyacrylic acid partial sodium salt;

wherein the hydrotrope is selected from the group of compounds consisting of: sodium xylene sulfonate, sodium toluenesulfonate, surfactant-hydrotropes, and urea;

wherein the water conditioner is selected from the group of compounds consisting of: chelating modifiers, sequestering modifiers, crystal modifiers, polymaleic acid, polyacrylate, ethylenediaminetetraacetic acid, nitrilotriacetic acid, sodium citrate, sodium gluconate, and sodium glucoheptonate; wherein the alkali is selected from the group of compounds consisting of: sodium hydroxide, potassium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, calcium oxide, magnesium oxide, calcium hydroxide, and magnesium hydroxide; and wherein the surfactant is selected from the group of compounds consisting of: anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid; and removing a material that is disposed on the equipment, without substantially dissolving the material, wherein the material is selected from a bituminous material, a tar material, a rubber material, a polymer material, and combinations thereof.

223. The method of claim 222, further comprising:

maintaining the cleanliness of the equipment so that the material does not substantially adhere to the equipment after the cleaning composition has been applied.

224. The method of claim 222, wherein the cleaning composition can be diluted in a solvent to prepare a cleaning composition solution.

225. The cleaning method of claim 222, wherein the builder comprises a builder salt having a cationic species, wherein the cationic species of the salt is selected from: sodium, potassium, calcium, magnesium, zinc, aluminum, barium, beryllium, ammonium, and lithium.

226. The method of claim 222, wherein the hydrotrope comprises a hydrotrope salt having a cationic species, wherein the cationic species of the salt is selected from: sodium, potassium, calcium, magnesium, zinc, aluminum, barium, beryllium, ammonium, and lithium.

227. The method of claim 222, wherein the water conditioner comprises a water conditioner salt having a cationic species, wherein the cationic species of the salt is selected from: sodium, potassium, calcium, magnesium, zinc, aluminum, barium, beryllium, ammonium, and lithium.

228. The method of claim 222, wherein the alkali comprises an alkali salt having a cationic species, wherein the cationic species of the salt is selected from: sodium, potassium, calcium, magnesium, zinc, aluminum, barium, beryllium, ammonium, and lithium.

229. The method of claim 222, wherein the processing aid comprises a processing aid salt having a cationic species, wherein the cationic species of the salt is selected from: sodium, potassium, calcium, magnesium, zinc, aluminum, barium, beryllium, ammonium, and lithium.

230. The method of claim 222, wherein the surfactant comprises a surfactant salt having a cationic species, wherein the cationic species of the salt is selected from: sodium, potassium, calcium, magnesium, zinc, aluminum, barium, beryllium, ammonium, and lithium.

* * * * *